US006029827A

United States Patent [19]

Valiulis

[11] Patent Number: 6,029,827

[45] Date of Patent: Feb. 29, 2000

[54] MOLDED PLASTIC DISPLAY HANGER WITH PROJECTING TOOTH

[75] Inventor: Stanley C. Valiulis, Rockford, Ill.

[73] Assignee: Southern Imperial, Inc., Rockford, Ill.

[21] Appl. No.: 08/359,407

[22] Filed: Dec. 20, 1994

[51] Int. Cl.[7] ..... B42F 7/00

[52] U.S. Cl. ..... 211/59.1; 248/217.3; 248/229.16

[58] Field of Search ..... 248/217.3, 229.16, 248/228.7, 230.7, 225.11, 216.1, 220.21, 220.31; 211/59.1, 57.1

[56] References Cited

U.S. PATENT DOCUMENTS

| | | | |
|---|---|---|---|
| 2,109,213 | 2/1938 | Fearing | 248/217.3 X |
| 3,425,655 | 2/1969 | Cogdill | 248/217.3 X |
| 3,447,823 | 6/1969 | Gregoire | 248/217.3 X |
| 3,476,343 | 11/1969 | Burrell | 248/217.3 X |
| 4,671,417 | 6/1987 | O'Brien | 211/59.1 |
| 4,724,967 | 2/1988 | Valiulis | 211/59.1 |
| 5,439,120 | 8/1995 | Brozak | 211/59.1 |

*Primary Examiner*—Ramon O. Ramirez
*Attorney, Agent, or Firm*—Leydig, Voit & Mayer Ltd

[57] ABSTRACT

A molded plastic hanger for displaying articles in front of a generally upright panel made of paperboard or the like. The hanger includes a clip having a slot sized to receive an edge portion of the panel and an elongated arm for supporting the articles. Relatively small teeth are integrally molded in the clip. The teeth are adapted to allow the clip to slip onto the edge of the panel and then to bite into the panel so as to resist removal of the hanger from the panel.

5 Claims, 2 Drawing Sheets

MOLDED PLASTIC DISPLAY HANGER WITH PROJECTING TOOTH

BACKGROUND OF THE INVENTION

This invention relates generally to a hanger adapted to be mounted onto a display unit and adapted to support one or more articles. More specifically, the invention relates to a hanger specially adapted to be mounted onto a generally horizontally extending upper edge portion of an upright corrugated or paperboard panel for displaying articles of merchandise in front of the panel.

A display hanger of this general type includes a clip for mounting the hanger onto the edge portion and a forwardly extending arm to carry the merchandise. Each article includes an opening for receiving the arm so that the merchandise can be individually slipped onto and off of the hanger.

The clip is typically formed with an inverted J-shape or an inverted U-shape defining a downwardly opening slot adapted to receive the edge portion of the panel. The slot enables the clip to be slid downwardly onto the panel. A front support defined on the clip rests against the front of the panel to support the weight of the merchandise. Additionally, the clip may be sized to snugly receive the edge portion of the panel so that friction between the clip and the panel aids in supporting the weight of the merchandise and keeping the hanger on the panel. However, if too much weight is placed on the arm of a prior hanger of this type, the clip will tend to slip upwardly and off of the panel. Also, if a prior hanger of this type is accidently bumped, the clip may be knocked off of the panel.

SUMMARY OF THE INVENTION

The general aim of the present invention is to provide a new and improved hanger which is easily slipped onto an edge portion of a paperboard panel but which is more securely held to the panel.

A more detailed objective is to achieve the foregoing by providing a hanger having a resilient clip which is adapted to slide downwardly onto the edge portion of the panel and which releasably bites into the panel to normally prevent the clip from inadvertently sliding upwardly and off of the panel.

A still more detailed objective is to provide a molded plastic clip having a slot adapted to snugly receive the edge portion of the panel and having integrally molded teeth which slide along the back of the panel as the clip is slipped onto the panel but which bite into the back of the panel when the clip is seated on the edge of the panel.

These and other objects and advantages of the invention will become more apparent from the following detailed description when taken in conjunction with the accompanying drawings.

Figure 1:
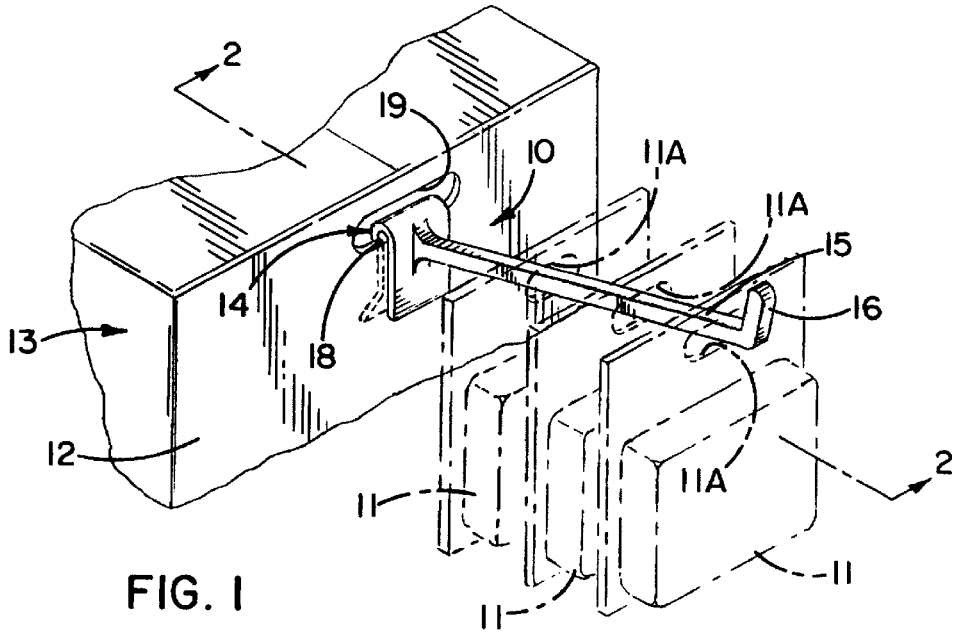
FIG. 1 is a perspective view of a typical display carton equipped with a new and improved display hanger incorporating the unique features of the invention.

While the invention is susceptible of various modifications and alternative constructions, a certain illustrated embodiment hereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DETAILED DESCRIPTION OF THE PREFERRED EMBODIMENT

For purposes of illustration, the present invention is shown in the drawings as embodied in a hanger 10 (FIG. 1) which is particularly suitable for displaying articles 11 such as packaged merchandise in front of a generally upright panel such as a side panel 12 of a corrugated or paperboard display carton 13. The display carton typically holds an additional supply of articles to be placed onto the hanger.

The hanger 10 is preferably molded from resilient plastic and includes a clip 14 for mounting the hanger onto the panel 12. An integrally molded arm 15 projects forwardly from the clip for supporting the packaged articles 11. Each article includes an opening 11A sized to slidably receive the arm so that the articles can be individually slipped onto and off of the hanger. The opening 11A is typically formed in a card or other reinforced portion of the packaging.

Figure 2:
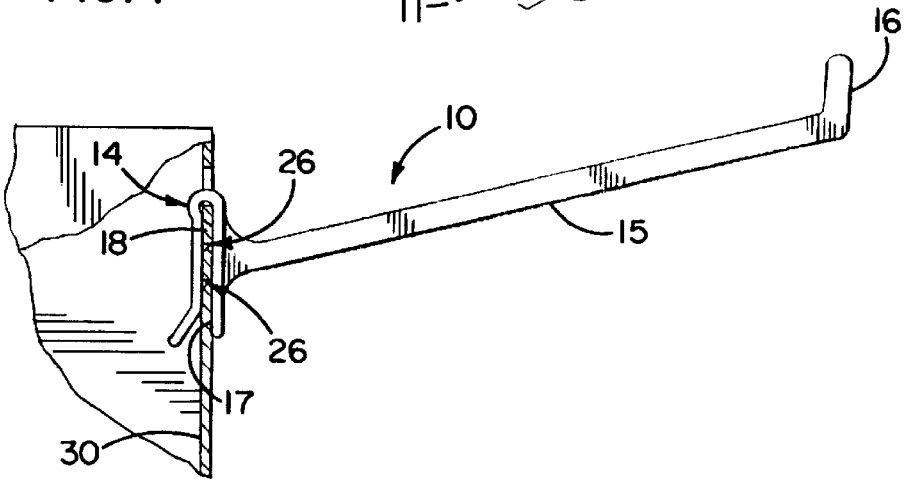
FIG. 2 is a cross-section taken substantially along the line 2—2 of FIG. 1.

Advantageously, the arm 15 (FIG. 2) is inclined upwardly upon progressing away from the clip 14. As each article 11 is slipped onto the inclined arm, gravity tends to cause that article to slide downwardly, automatically making room for the next article. The tip portion 16 of the arm extends generally vertically from the free end portion of the arm. The tip portion allows the hanger 10 to be filled with articles while preventing the articles near the free end of the arm from being accidently bumped off of the hanger.

In general, the clip 14 is formed with a downwardly opening slot 17 to enable the clip to be slipped onto a generally horizontally extending upper edge portion 18 of the panel 12. In this instance, the edge portion 18 of the side panel is defined by the lower edge of a horizontal slot 19 in the side panel.

Figure 3:
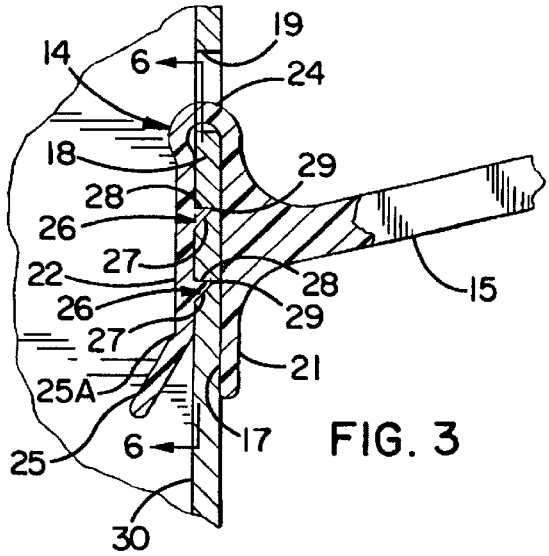
FIG. 3 is an enlarged view of certain parts shown in FIG. 2.

More specifically, the clip 14 (FIG. 3) is formed with front and back supports 21 and 22, respectively. The upper portions of the supports are joined to one another by a resilient radius portion 24 to define the downwardly opening slot 17. The clip is molded so that the back support normally approaches the front support, i.e., the width of the slot 17 narrows, upon progressing downwardly from the radius portion to a knee 25A defined in the back support. The lower end portion 25 of the back support is then inclined away from the front support upon progressing downwardly from the knee 25A to define an enlarged opening to the slot 17. Additionally, the end portion 25 extends past the lower end of the front support.

With the foregoing arrangement, the hanger 10 is mounted onto the panel 12 by inserting the lower end portion 25 of the back support 22 into the slot 19 and pivoting the clip 14 counterclockwise while pressing downwardly on the clip. As the narrow portion of the slot 17 defined at the knee 25A is pressed past the edge of the panel, the front and back supports 21 and 22 resiliently separate and the edge portion 18 is snugly received in the slot 17. The radius portion 24 is preferably enlarged with respect to the width of the edge portion 18 to keep the bending stress at the root of the slot 17 relatively low.

In accordance with the present invention, the hanger 10 is formed with generally upwardly angled teeth 26 which project forwardly into the slot 17. The teeth are adapted to allow the clip 14 to slide downwardly onto the edge portion 18 of the panel 12 and then to grip the back of the panel. As a result, the hanger 10 may be slipped onto the edge of the panel and is then securely held to the panel.

Figure 6:
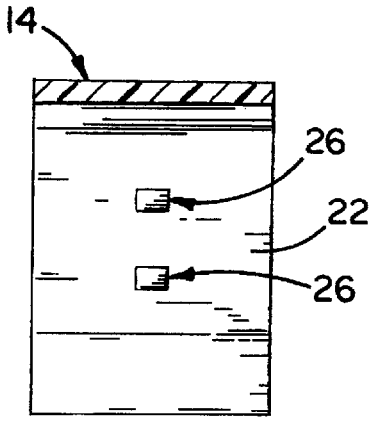
FIG. 6 is a view taken substantially along the line 6—6 of FIG. 3.

More specifically, at least one and preferably two relatively narrow teeth 26 (FIG. 6) are integrally molded in the clip 14. The teeth project generally forwardly from the inside surface of the back support 22 and into the slot 17 to engage the panel 12 as the clip is slipped onto the panel. The teeth are preferably vertically spaced from one another and generally aligned with the arm 15 to prevent the clip from tending to twist or rotate as the clip is pressed downwardly onto the panel.

Each tooth 26 is formed with an upwardly angled lower surface 27 and a generally horizontal upper surface 28. These surfaces 27 and 28 meet in the slot 17 to define a free end portion having a relatively sharp edge 29. The teeth are sized so that the space between the edge 29 of the each tooth and the inner surface of the front support, as measured prior to installation of the hanger 10, is less the thickness of the panel 12.

Figure 4:
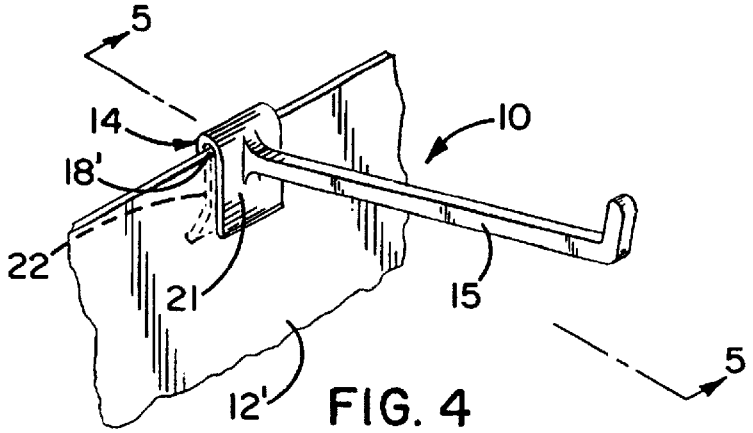
FIG. 4 is a view similar to FIG. 1 but shows the hanger mounted to the upper edge of a vertical panel.
Figure 5:
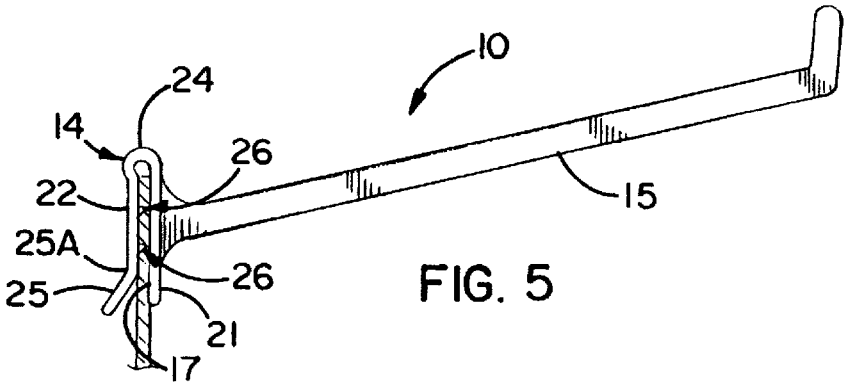
FIG. 5 is a cross-section taken substantially along the line 5—5 of FIG. 4.

With the foregoing arrangement, the teeth 26 normally permit one-way relative motion between the slot 17 and the edge portion 18 of the panel 12. When the clip 14 is slipped onto the edge portion 18 as previously described, the lower surface 27 of each tooth 26, in turn, rides over the upper edge of the panel and causes the back support 22 to resiliently deflect rearwardly relative to the front support 21. So long as the clip is moving continuously downwardly, the edges 29 of the teeth slide along the back surface 30 of the panel. When the downward motion of the clip stops, such as when the radius portion 24 engages the edge of the panel, the back support springs forwardly toward the panel and causes the teeth to bite into the back of the panel. As a result, the teeth firmly grip the panel and normally prevent the clip from backing upwardly and off of the panel. The hanger 10 is equally suitable for mounting to, for example, the horizontal edge portion 18' defined by the upper free edge of a vertical panel 12' (FIG. 4). In this instance, the hanger is mounted to the panel 12' by aligning the slot 17 with the edge of the panel and simply pressing downwardly. Advantageously, the incline of the lower end portion 25 aids in guiding the clip 14 onto the edge of the panel 12'.

From the foregoing, it will be apparent that the present invention brings to the art a new and improved hanger 10 which is easily slipped onto an edge portion 18, 18' defined by, for example, a slot 19 formed in the side panel 12 or by the free edge of the vertical panel 12' but which is normally precluded from shifting relative to the edge portion. By virtue of the resilient clip 14 having integrally formed teeth 26 with upwardly sloping lower surfaces 27, the clip may be slid downwardly onto the panel whereupon the clip resiliently closes on the edge portion of the panel and the teeth bite into the back of the panel. Accordingly, the hanger is capable of more securely supporting the articles 11 and is precluded from inadvertently slipping on or being knocked off of the panel.

I claim:

1. A molded plastic hanger adapted to slip onto an edge portion of a paperboard panel and adapted to support a plurality of articles, said hanger comprising a clip having a slot sized to receive said edge portion, an integrally molded arm extending from said clip for carrying said articles, and an integrally molded tooth projecting from said clip, said tooth having a relatively sharp end portion adapted to bite into said edge portion so as to resist removal of said clip from said edge portion and having an inclined surface adapted to slidably engage the edge of said panel when said clip is slipped onto said edge portion.

2. A molded plastic hanger adapted to be mounted onto a generally horizontally extending edge portion of an upright paperboard panel and adapted to support a plurality of articles, said hanger comprising a clip having generally vertical front and back members, said members having upper end portions resiliently joined to one another so that said members define a downwardly opening slot for receiving said edge portion, an elongated arm extending forwardly from said front member for supporting said articles, and a plurality of teeth integrally formed in said back member, said teeth having relatively sharp end portions projecting forwardly into said slot so as to restrict the width of said slot to a size less than the thickness of said edge portion, each of said teeth having a lower surface adapted to slidably engage the edge of said panel as said edge portion is received in said slot whereby said edge portion causes said back member to resiliently deflect rearwardly relative to said front member as said clip is slid downwardly onto said edge portion, said back member springing forwardly and causing said end portions to bite into said panel after said edge portion has been received in said slot whereby said end portions resist removal of said hanger from said panel.

3. A hanger as defined in claim 2 in which each of said teeth is formed with an upwardly sloping lower surface for slidably engaging the edge of said panel and a generally horizontal surface for resisting removal of said clip from said panel.

4. A hanger as defined in claim 2 in which said teeth are vertically aligned relative to one another.

5. A hanger as defined in claim 2 in which said clip is molded from resilient plastic, and wherein said arm and said teeth are integrally molded with said clip.

* * * * *